United States Patent [19]

La See

[11] Patent Number: 4,947,606

[45] Date of Patent: Aug. 14, 1990

[54] VISION PANEL ASSEMBLY

[76] Inventor: Jack C. La See, 308 West Cedar, Abbotsford, Wis. 54405

[21] Appl. No.: 491,521

[22] Filed: Mar. 12, 1990

[51] Int. Cl.[5] ..... E06B 3/70

[52] U.S. Cl. ..... 52/455; 49/460; 52/476; 52/727; 52/825

[58] Field of Search ..... 52/455, 476, 823, 824, 52/825, 208, 727, DIG. 8; 49/171, 460, 462

[56] References Cited

U.S. PATENT DOCUMENTS

| | | | |
|---|---|---|---|
| 3,107,759 | 10/1963 | Day et al. | 52/212 |
| 3,478,478 | 11/1969 | Luebs | 52/727 X |
| 3,821,870 | 7/1974 | Sittmann | 52/825 |
| 3,918,207 | 11/1975 | Aliotta | 49/402 |
| 4,139,971 | 2/1979 | Kimura | 52/208 |
| 4,550,542 | 11/1985 | La See | 52/455 X |

*Primary Examiner*—Philip C. Kannan

[57] ABSTRACT

A vision panel assembly for a fire door is provided with a decorative shielding unit which enhances the appearance of the fire door and renders the vision panel assembly substantially tamper-proof.

2 Claims, 1 Drawing Sheet

VISION PANEL ASSEMBLY

This invention relates to fire doors and, more particularly, to improvements in vision frame assemblies for fire doors.

BACKGROUND OF THE INVENTION

Most conventional fire doors are provided with vision panels, which are typically sold as a separate assembly. The vision panel assemblies usually include a metal frame and a transparent fire-resistant wire glass panel, which is clamped by the frame in the manner of my U.S. Pat. No. 4,550,542.

The vision panel frames for certain commercial vision panel assemblies must be constructed of steel to withstand a 1700 degree Fahrenheit fire test, while the fire door has a wood veneer exterior and an insulating mineral core interior. The nut and bolt assemblies used to clamp the metal vision panel frames to the fire door are exposed in certain commercial vision panel assemblies.

SUMMARY OF THE INVENTION

It is an object of this invention to provide the vision panel assembly for a fire door with a decorative shielding unit, which enhances the appearance of the fire door and renders the vision panel assembly substantially tamper-proof.

In one embodiment of the invention, the decorative shielding unit includes a plurality of aluminum cover elements, each secured to and covering a frame element of the vision frame assembly. Each aluminum cover element is secured to one of the frame elements of the vision panel assembly by adhesive elements. A wood veneer element having an adhesive surface is secured to each aluminum cover element.

In another embodiment, a veneer element is secured directly to a metallic frame element and is provided with an access opening for providing access to the associated nut and bolt assembly, which secures the vision panel frame to the fire door. Each of these access openings are closed by a closure element formed of the same material as the veneer element.

FIGURES OF THE DRAWING

DESCRIPTION OF THE PREFERRED EMBODIMENT

Figure 1:
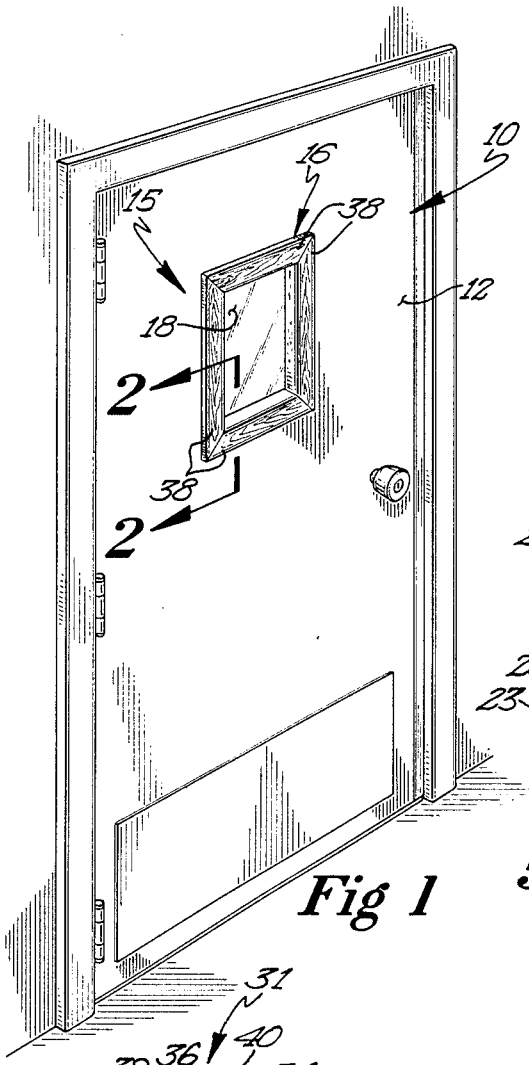
FIG. 1 is a perspective view of a fire door having a commercial vision panel assembly, which incorporates the novel shielding decorative means.
Figure 2:
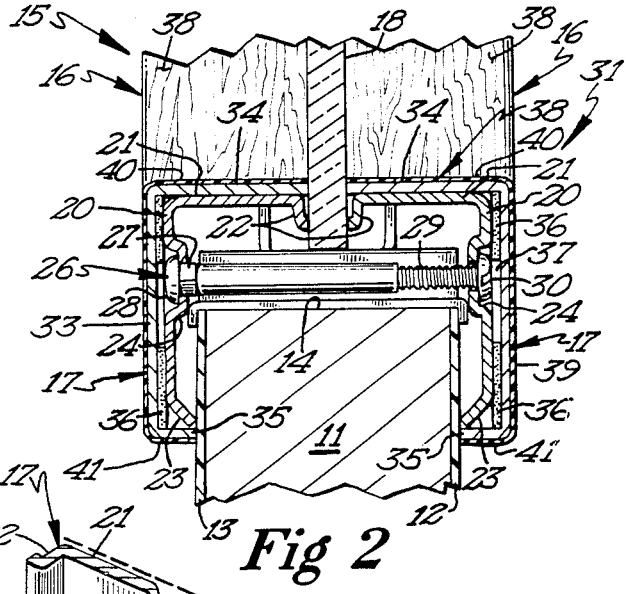
FIG. 2 is a cross-sectional view taken approximately along the lines 2—2 of FIG. 1 and looking in the direction of the arrows.
Figure 3:
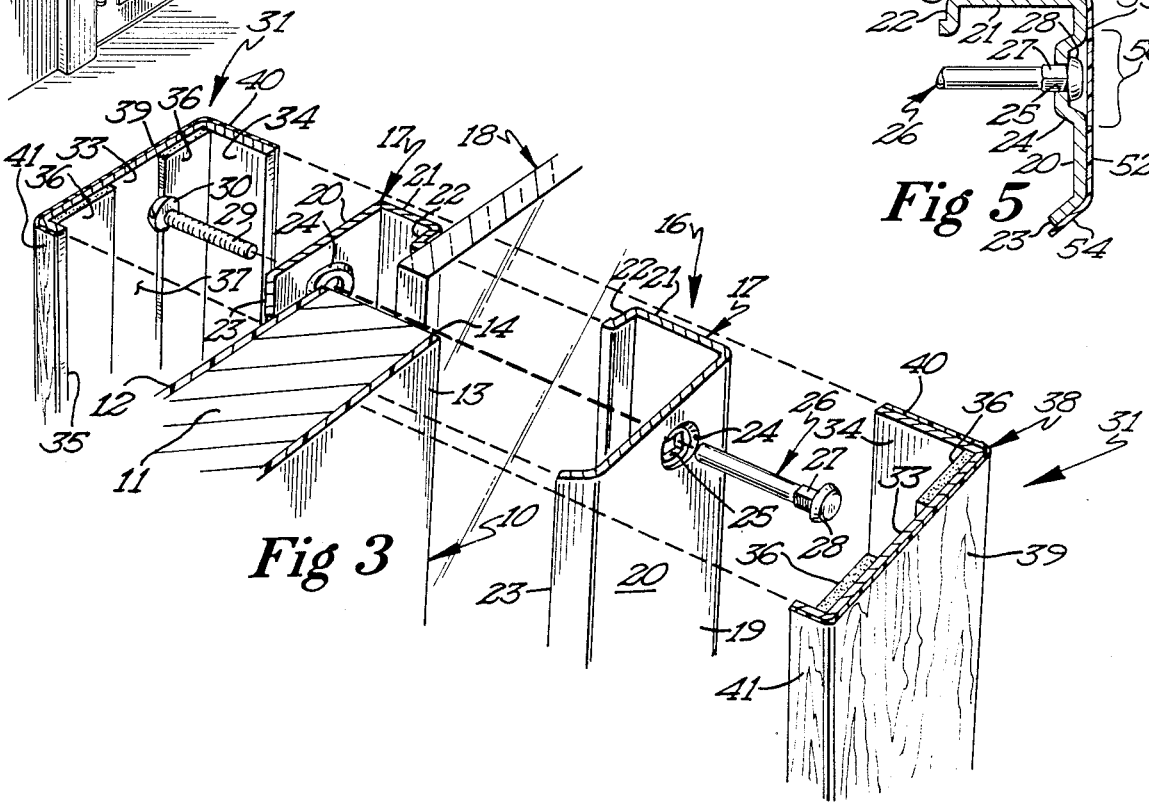
FIG. 3 is an exploded perspective view of a portion of the vision panel assembly illustrating details of construction thereof and also illustrating components of the decorative shielding unit.

Referring now to the drawings, and, more particularly, to FIGS. 1-3, it will be noted that a commercial fire door 10 is thereshown and includes a core panel 11 formed of a suitable insulating material and provided with a wooden front panel 12 and a wooden rear panel 13. The fire door is provided with a rectangular opening 14 therein, which accommodates the vision panel assembly 15. The vision panel assembly 15 is substantially identical to that shown in my U.S. Pat. No. 4,550,542, and the disclosure of U.S. Pat. No. 4,550,542 is incorporated by reference herein.

The vision panel assembly 15 includes a vision panel frame 16, which is comprised of a pair of substantially similar frame members 17, each being of a generally rectangular configuration. The frame members 17 are clamped to the door 10 adjacent the periphery of the vision panel 15 and serve to clamp the generally rectangular-shaped wire glass panel 18 therebetween. One of the frame members is clamped against the front panel 12, and the other frame member is clamped against the rear panel 13.

Each frame member 17 is formed of four elongate rigid metallic frame elements 19, each element being rigidly secured at its ends to the adjacent frame elements in right angular relation. Each frame element 19 includes a planar central web 20 having an inturned flange 21 integral therewith, which terminates in a panel engaging lip 22. Each frame element also includes an inturned flange 23, which is integral with the central web 20. It is pointed out that the frame elements 19 for each frame are rigidly secured together at their ends to form mitered corners.

Each frame element 19 of each frame member also has a rectangular aperture or opening 25 therein, and the opening is recessed, as at 24, for accommodating a nut and bolt assembly. The nut and bolt assembly includes an elongate and internal threaded sleeve nut 26, having a rectangular locking portion 27, which terminates in a smooth head 28. The locking portion 27 of the sleeve nut projects through the square aperture 25 to lock the sleeve nut against rotation.

The nut and bolt assembly also includes a bolt having an elongated threaded shank 29 and a slotted head 30. When the nut and bolt assemblies clamp the frame members 17 together, it will be seen that the flange 23 for each frame element of each frame member engages the door 10 adjacent the periphery of the opening 14. It will also be seen that the glass panel 18 is engaged by and clamped between the panel engaging lip 22 of the frame elements for each frame member. Although not shown in the drawing, it is also pointed out that the frame 16 will be provided with support elements and spring clips, as disclosed in my U.S. Pat. No. 4,550,542.

The vision panel assembly 15 is also provided with a decorative shield unit 31, which serves not only to enhance the appearance of the vision panel assembly, but also renders the vision panel substantially tamper-proof. The decorative shield unit 31 includes a pair of substantially similar rectangular aluminum shield frames, each comprised of four elongate aluminum shield elements 32 rigidly secured together at mitered corners to provide a rectangular shield for each frame member 17. Each aluminum shield element 32 includes a web portion 33 having flanges 34 and 35 integrally formed therewith and extending at substantially right angles therefrom. It will be seen that the web portion 33 of each shield element overlies the web 20 of each frame element 19 and that each flange 34 overlies each flange 21, while flange 35 overlies the flange 23.

The web portion 33 of each aluminum shield element is provided with a pair of elongate double-foam adhesive strip elements 36, which are secured to the inner surface of the web portion, and which engage and are secured to the exterior surface of the central web 20 of one of the frame elements 19. It will be noted that the adhesive elements 36 for each web portion 33 are laterally spaced apart to define a space 37 between adjacent strips, and this space overlies the central portion of the web 20 and the respective heads of the nut and bolt assemblies.

Each aluminum shield element 32 is provided with a veneer cover element 38, which covers the shield element. The veneer cover element simulates wood and includes a central portion 39, a flange covering portion 40, and a flange covering portion 41. The inner surface of the veneer cover element is adhesive-coated to permit adherence to the associated shield element. The central portion 39 of each veneer element covers the web portion 33 of the shield element, while the flange covering portions 40 and 41, respectively, cover the flanges 34 and 35, respectively.

It is pointed out that the veneer cover elements 38 may be stained to correspond to the color of the wood panels for the fire door, to thereby enhance the appearance of the vision panel assembly. It will also be noted that the aluminum shield elements virtually render the vision panel assembly tamper-proof, since the nut and bolt assemblies are completely covered and protected by these aluminum shielding frames.

Figure 4:
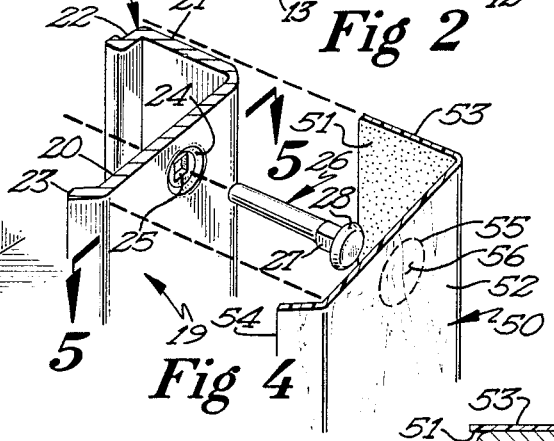
FIG. 4 is a fragmentary exploded perspective view of a slightly different embodiment of the decorative shielding unit.
Figure 5:
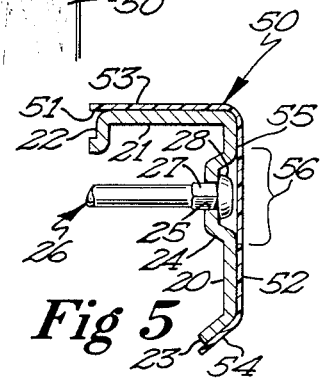
FIG. 5 is a cross-sectional view taken approximately along the lines 5—5 of FIG. 4 and looking in the direction of the arrows.

Referring now to FIGS. 4 and 5, it will be seen that a slightly different embodiment of the decorative shield unit 31 is thereshown. In the embodiment illustrated in FIGS. 4 and 5, the decorative shield unit, designated generally by the reference numeral 49, includes a veneer cover element 50 having an adhesive inner surface 51 that is applied directly to the frame elements 19 of each frame member 17.

Each veneer cover element includes a central portion 52, which engages and covers the web 20 of each frame element. Each cover element also includes a flange 53 and a flange 54 integral with the central portion thereof, which respectively covers the flanges 21 and 23 of the frame elements. However, it will be noted that each cover element 50 has an opening 55 therein to permit the nut and bolt assemblies to be applied during installation of the vision panel assembly on a fire door 10. The opening 55 is closed by a closure element 56, which is also formed of the same material as the veneer cover element. Again, it will be noted that the nut and bolt assemblies are completely covered and sealed by the decorative shield unit 49.

From the foregoing, it will be seen that my novel vision panel assembly for a fire door provides the fire door with a decorative shielding unit, which enhances the fire door and renders the vision panel assembly substantially tamper-proof.

What is claimed is:

1. In combination with a fire-resistant door having a rectangular opening therein, a fire-resistant vision panel assembly mounted in said opening and including a pair of similar rectangular metallic frame members and a rectangular fire-resistant transparent glass vision panel, nut and bolt assemblies clamping the frame members against the periphery of the vision panel and against opposite surfaces of the door adjacent the periphery of the opening therein, each frame member being comprised of elongate frame elements, each including a web portion having a pair of flanges extending angularly therefrom, a decorative shield unit for covering the frame members of said vision panel assembly, including a pair of generally rectangular-shaped shield frames formed of aluminum, each shield frame comprised of elongate frame elements, a plurality of adhesive elements disposed between and engaging and securing each aluminum shield frame in overlying relation to one of said frame members, and decorative veneer elements having adhesive surfaces overlying and being secured to said shield frame members.

2. In combination with a fire-resistant door having a rectangular opening therein, a fire-resistant vision panel assembly mounted in said opening and including a pair of similar rectangular metallic frame members and a rectangular fire-resistant transparent glass vision panel, nut and bolt assemblies clamping the frame members against the periphery of the vision panel and against opposite surfaces of the door adjacent the periphery of the opening therein, each frame member being comprised of elongate frame elements, each including a web portion having a pair of flanges extending angularly therefrom, each frame element having an opening therein for accommodating a nut and bolt assembly, and a decorative shield unit for covering the frame members of said vision panel assembly, including decorative veneer elements having adhesive surfaces overlying and being secured to said shield frame members, each veneer element including a central portion overlying and being secured to the web portion of a frame element, and including flange portions overlying and being secured to the flanges of a frame element, the central portion of each veneer element having an opening therein disposed in registering relation with the opening in the associated frame element, and a closure element for each central portion shaped and sized to close the opening in the central portion and being made of the same material as said veneer elements.

* * * * *